US006626525B1

(12) United States Patent
Nakamura et al.

(10) Patent No.: US 6,626,525 B1
(45) Date of Patent: Sep. 30, 2003

(54) ACTUATOR FOR AN INK JET RECORDING HEAD

(75) Inventors: Hirofumi Nakamura, Tokyo (JP); Torahiko Kanda, Tokyo (JP)

(73) Assignee: Fuji Xerox Co. Ltd (JP)

( * ) Notice: Subject to any disclaimer, the term of this patent is extended or adjusted under 35 U.S.C. 154(b) by 0 days.

(21) Appl. No.: 09/391,742

(22) Filed: Sep. 8, 1999

(30) Foreign Application Priority Data

Sep. 8, 1998 (JP) ..... 10-254202

(51) Int. Cl.[7] ..... B41J 2/045
(52) U.S. Cl. ..... 347/70
(58) Field of Search ..... 347/70, 68, 54, 347/69–72, 94, 65, 63; 29/25.35; 310/330, 332, 311, 313 A, 316.01, 357–359, 365

(56) References Cited

U.S. PATENT DOCUMENTS

| | | | | |
|---|---|---|---|---|
| 5,255,016 A | * | 10/1993 | Usui et al. | 238/355 |
| 5,719,604 A | * | 2/1998 | Inui et al. | 347/54 |
| 5,956,829 A | * | 9/1999 | Kitahara et al. | 29/25.35 |
| 5,988,799 A | * | 11/1999 | Abe et al. | 347/68 |

FOREIGN PATENT DOCUMENTS

| | | | | |
|---|---|---|---|---|
| DE | 19532913 | | 3/1996 | |
| DE | 19639436 | | 4/1997 | |
| JP | 1-1051 A | * | 1/1992 | B41J/2/045 |
| JP | 4-1051 | | 1/1992 | |
| JP | 4-125157 | | 4/1992 | B41J/3/04 |
| JP | 8-281947 | | 10/1996 | B41J/3/04 |
| JP | 9-1795 | | 1/1997 | B41J/3/04 |
| JP | 9-85946 | | 3/1997 | B41J/3/04 |
| JP | 9-104109 | | 4/1997 | B41J/3/04 |

* cited by examiner

*Primary Examiner*—Lamson Nguyen
*Assistant Examiner*—K. Feggins
(74) *Attorney, Agent, or Firm*—Dickstein, Shapiro, Morin & Oshinsky, LLP.

(57) ABSTRACT

A pressurizing unit for pressurizing ink filling a pressure chamber in response to an electric signal is constructed with a beam and a support portion. The support portion is preferably formed integrally with the beam and supports the beam at opposite end portions thereof. The support portion receives a bending force and a shearing force, with are generated at the opposite end portions by a buckling deformation of the beam when the beam is expanded in its longitudinal direction by an application of the electric signal.

31 Claims, 6 Drawing Sheets

ACTUATOR FOR AN INK JET RECORDING HEAD

CROSS REFERENCE TO RELATED APPLICATIONS

The present invention claims priority from Japanese Patent Application No. 10-254202 filed Sep. 8, 1998, the contents of which are incorporated herein by reference.

BACKGROUND OF THE INVENTION

1. Field of the Invention

The present invention relates to an actuator of an ink jet recording head, for recording characters and/or pictures by jetting ink droplets to a recording medium such as a recording sheet.

2. Description of Related Art

FIG. 9 is a cross section of an actuator of a conventional ink jet recording head, showing a structure of a main portion of the actuator. This structure has a purpose of illustrating a structure of one of pressure chambers of the ink jet recording head and one of ink nozzles thereof. In this conventional structure, a space defined by nozzle plate 31 formed of a rigid material and casing 34 formed of a rigid material is used as pressure chamber 33, which is filled with externally supplied ink 5. Nozzle 32 for jetting ink droplet 1 is formed in nozzle plate 31 and drive plate 35 is provided within pressure chamber 33. Drive plate 35 is formed of a piezoelectric material (or a material having large thermal expansion coefficient) and has opposite surfaces, on which electrodes 39 are formed, respectively. When a voltage is applied across electrodes 39 from power source 40 through switch 37 as an electric signal, drive plate 35 is deformed in a direction shown by, for example, an arrow by the piezoelectric effect (or thermal expansion) as shown, to pressurize ink 5 filling pressure chamber 33 to thereby jet ink droplet 1 out through nozzle 32.

In this conventional structure, drive plate 35 is put on support portion 38 and adhered thereto as shown in FIG. 10 (Japanese Patent Application Laid-open No. Hei 9-85946). That is, in order to control the direction of deformation constant, one of the surfaces of drive plate 35 is fixed by adhesive to support portion 38, by which displacement thereof is restricted. Therefore, a compressive reactive force is exerted on a portion between drive plate 35 and support portion 38 as shown by horizontal inward arrows in FIG. 10, every time when the pressure chamber is driven.

That is, since, when the actuator having such structure is driven, a reactive force of the driving force is repetitively exerted on the adhesive layer between driving plate 35 and support portion 38, shearing deformation tends to occur in the adhesive layer. When such shearing deformation occurs in the adhesive layer, displacement in a direction parallel to the plane of driving plate 35 is relieved thereby and, therefore, an amount of displacement of driving plate 35 in a direction shown by a thick arrow in FIG. 10 becomes small. If such shearing deformation is considerable, driving plate 35 may be peeled off from support portions 38 by the reactive force of the driving force. In the latter case, a driving force for pressurizing ink pressure chamber 33 may not be produced at all. That is, this phenomenon may cause the life of the ink jet recording head to be shortened. Further, in such structure of the actuator, an adhering step is required in a manufacture thereof. In such adhering step, a precise positioning is necessary, with which the number of manufacturing steps may be increased. Further, since a positioning error, a variation of adhering strength and a variation of thickness of the adhering layer, etc., are reflected on a variation of the ink jet characteristics, that is, printing characteristics, manufacturing yield of the ink jet recorder may be lowered.

SUMMARY OF THE INVENTION

The present invention was made in view of the above mentioned fact and has an object to provide an ink jet recording head whose ink jetting characteristics is not influenced directly by a positioning error, a variation of adhering strength and a variation of thickness of an adhesive layer, etc., thereof which may be caused by the necessity of adhesion of a driving plate to the support portion.

Another object of the present invention is to provide an ink jet recording head capable of being manufactured without using the adhering step for adhering a driving plate to a support portion.

Another object of the present invention is to provide an ink jet recording head capable of substantially increasing the number of effective reciprocal movements of the driving plate to thereby allow a life thereof to be lengthened.

A further object of the present invention is to provide an ink jet recording head which rarely breaks down and is highly reliable.

Another object of the present invention is to provide an ink jet recording head whose variation of performance over time is minimized.

Another object of the present invention is to provide an ink jet recording head capable of being manufactured with a small number of manufacturing steps.

A still further object of the present invention is to provide an ink jet recording head with which an ink jet recorder having a uniform performance can be manufactured.

Another object of the present invention is to provide an ink jet recording head which can be manufactured with high yield.

In order to achieve the above objects, the ink jet recording head according to the present invention, which has a structure in which an ink chamber is pressurized by utilizing a buckling deformation of a driving plate, is featured by that a pressuring unit has a structure in which an adhesive layer is not influenced by displacement caused by every pressurization of the ink chamber.

That is, in an ink jet recording head including a rigid member defining a pressure chamber formed with a nozzle for jetting ink droplet and a pressuring unit for pressurizing ink filling the pressure chamber correspondingly to an electric signal, the present invention is featured by that the pressurizing unit comprises at least one beam supported at opposite end portions thereof and a support portion for supporting the opposite end portions of the beam and restricting an expansion of the beam in its longitudinal direction such that, when the beam is expanded in the longitudinal direction due to an application of the electric signal, the expanded portion of the beam is buckled into the pressure chamber.

The beam is made of a piezo-electric material. At least one electrode for applying an electric signal is formed on a surface of the beam. Alternatively, the beam may be made of a material having large thermal expansion coefficient and a heater for heating the beam upon an application of the electric signal may be provided. The beam and the support portion are preferably formed integrally. The beam and the support portion may be integrally formed from a piezo-electric material sheet by punching and the electrode is formed on the beam.

A recess for controlling a direction of buckling deformation of the beam is formed in the beam. It is possible to form such recess at a position deviated in the longitudinal direction of the beam from a center of the beam or it is possible to provide an electrode for controlling the direction of buckling deformation of the beam on the latter partially.

The pressurizing unit pressurizes ink in the pressure chamber having the nozzle for jetting ink droplet in response to the electric signal. The pressurization is performed by applying the electric signal to the beam formed continuously to the support portion for restricting the expansion of the beam in its longitudinal direction to expand the beam in the same direction to thereby buckle the beam into the pressure chamber. By this buckling deformation of the beam, ink in the pressure chamber is pressurized and jetted through the nozzle as ink droplet.

In order to realize the buckling deformation of the beam, the beam may be formed of a piezo-electric material and an electric signal is applied to an electrode provided on a surface of the beam. When the electric signal is applied to the electrode, the beam is expanded in its longitudinal direction, buckled toward the pressure chamber and pressurizes the pressure chamber.

Alternatively, the beam may be formed of a material having large thermal expansion coefficient and it is possible to form the beam of a material having large thermal expansion coefficient and, by applying the electric signal to a heater provided on a surface of the beam to heat the beam to pressurizing the ink chamber.

By integrally constructing the beam having the buckling structure and the support portion supporting the opposite end portions of the beam, there is no need of receiving a reactive force against a shearing force produced between the opposite end portions of the beam and the support portion by an adhesive layer when a buckling deformation occurs, so that it is possible to realize the buckling deformation effectively. Incidentally, the buckling deformation is realized within the elastic limit of the beam.

The integral structure of the beam and the support portion can be easily realized by cutting it out from a plate of piezo-electric material and the pressurizing part can be manufactured by merely providing an electrode on the thus formed beam.

The buckling deformation of the beam must be in the direction toward the pressure chamber filled with ink. In order to make the direction of buckling deformation constant, a recess is formed in a surface of the beam on the side opposite to the direction. With such recess, it becomes possible to buckle the beam in the direction constantly when the electric signal is applied to the electrode or the heater provided on the beam. Further, it is possible to set an amount of buckling deformation required for the pressurizing unit by changing the depth of the recess.

The position of the recess in the beam is not always a center of the beam in its longitudinal direction and the recess can be formed at a position deviated from the center. In the latter case, the length of the electrode formed on one side of the beam becomes different from that of the electrode formed on the other side of the beam. The amount of buckling deformation of the beam when the electric signal is applied to the shorter electrode is different from that when the electric signal is applied to the longer electrode and the amount of buckling deformation of the beam when the electric signal is applied to both the shorter and longer electrodes is also different from those when the electric signal is applied to the shorter or longer electrode. Therefore, with the structure of the present invention, it is possible to control the amount of ink to be jetted by selecting the electrode to which the electric signal is to be applied. Consequently, it becomes possible to jet an amount of ink required for a printing by controlling the application of the electric signal to the respective electrodes.

When the electrode is partially embedded in the beam, an axis of action of buckling deformation when the electric signal applied thereto becomes eccentric with respect to the axis of the beam. Therefore, in such case, it is possible to maintain the direction of buckling deformation of the beam constant even without the recess.

As mentioned, according to the present invention, the pressurizing unit can be formed by the beam and the support portion for supporting the beam at opposite end portions thereof, which are formed integrally. Therefore, there is no need of adhering the driving plate to the support member thereof and a reactive force for a force exerted on the beam in the longitudinal direction thereof is not exerted on the adhesive layer, contrary to the conventional ink jet recording head. Therefore, the positioning error, the variation of adhering strength and the variation of thickness of the adhesive layer, etc., do not influence the ink jetting characteristics of the ink jet recording head.

Further, since there is no reactive force exerted on the adhering portion of the constitutional members, the number of effective reciprocal drives of the vibration plate is increased and a change of performance of the ink jet recording head with time can be reduced. Therefore, a reduction of the life of the ink jet recording head due to occurrences such as the peeling-off of the adhesive layer can be avoided, thereby improving the reliability of the ink jet recording head.

Further, it is possible to manufacture the ink jet recorder having uniform performance with minimum number of manufacturing steps and to simplify the manufacturing work. Further, it is possible to make the quality of the ink jet recording head uniform and to improve the yield thereof.

BRIEF DESCRIPTION OF THE DRAWINGS

Specific embodiments of the present invention will now be described, by way of example only, with reference to the accompanying of drawings in which.

DETAILED DESCRIPTION OF THE PREFERRED EMBODIMENTS

Now, preferred embodiments of the present invention will be described with reference to the accompanying drawings.

(First Embodiment)

Figure 1:
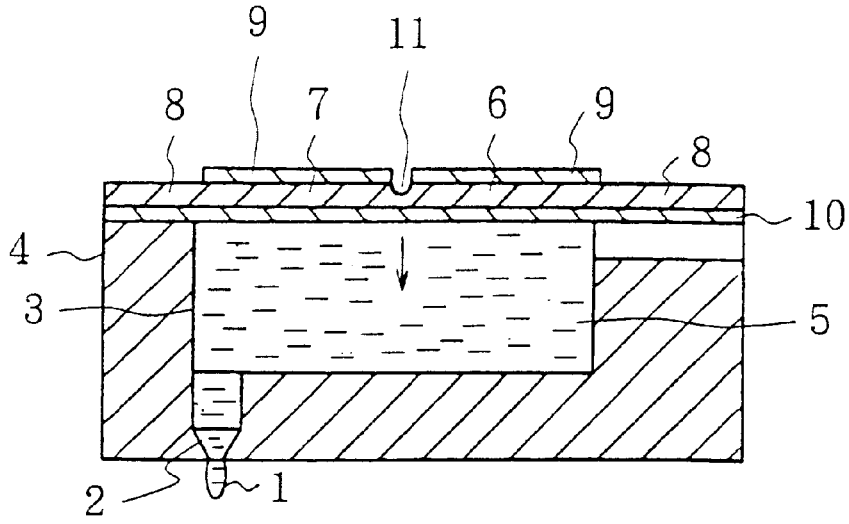
FIG. 1 is a cross section of an ink jet recording head according to a first embodiment of the present invention, showing a main portion thereof.
Figure 2:
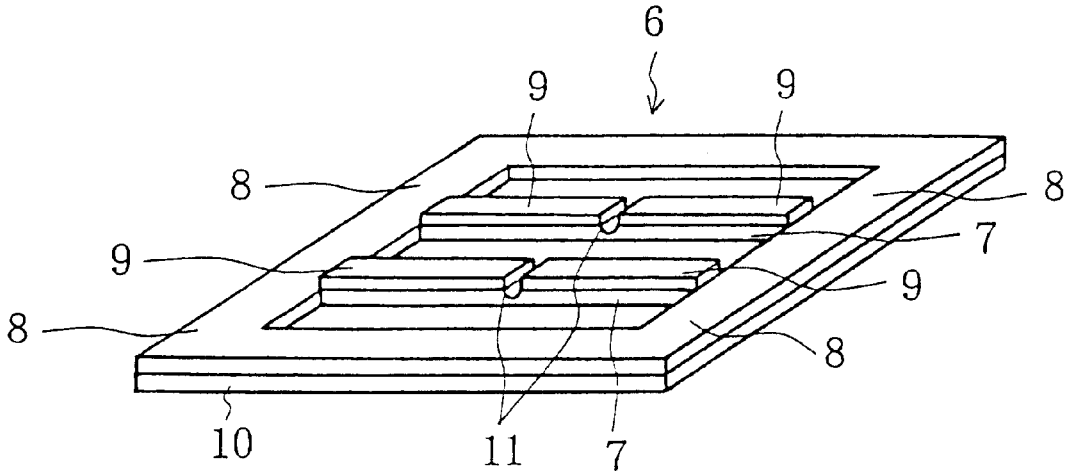
FIG. 2 is a perspective view of a main portion of a pressurizing unit used in the ink jet recording head of the first embodiment of the present invention.

FIG. 1 is a cross section of an ink jet recording head according to the present invention, showing a main portion thereof, and FIG. 2 is a perspective view of a main portion of a pressurizing unit used in the ink jet recording head shown in FIG. 1.

The ink jet recording head according to the first embodiment comprises rigid member 4, in which pressure chamber 3 formed with nozzle 2 for jetting ink droplet 1 is defined, and pressurizing unit 6 for pressurizing ink 5 filling pressure chamber 3 in response to an electric signal. Pressurizing unit 6 comprises beams 7 and support member 8 in the form of a frame for supporting opposite end portions of respective beams 7. Support member 8 acts to restrict expansion of beams 7 in a longitudinal direction thereof such that, when beams 7 are expanded in the longitudinal direction thereof by an application of an electric signal thereto, a portion of beam 7, corresponding to the expansion thereof, is buckled down into a space of pressurizing chamber 3.

Pressurizing unit 6 including beams 7 and support member 8 may be integrally formed of a piezo-electric material by, for example, punching a single piezo-electric material sheet. Discrete electrodes 9 are provided on one (upper) surfaces of beams 7 and common electrode 10 is provided on the other (lower) surface thereof and on the lower surface of support member 8. Electric signals are supplied between discrete electrodes 9 and common electrode 10. Recesses 11 are formed at substantial center portions of the upper surfaces of beams 7. Beams 7 having recesses 11 and support member 8 constitute a buckling structure for controlling a direction of the buckling deformation of the beams. Although pressurizing unit 6 is shown as having two beams 7 in FIG. 2, the number of beams 7 is not limited thereto.

The piezo-electric material for forming pressurizing unit 6 may be lead zirconate titanate ceramic or usual ferroelectric material. Discrete electrodes 9 may be formed of sliver paste, silver palladium paste or other electrically conductive metal. Common electrode (vibration plate) 10 may be formed from a nickel plate or other electrically conductive metal plate. Instead of common electrode 10, an electric heater may be used to deform the beam by heating the latter.

A manufacturing method of pressurizing unit 6 used in the first embodiment will be described with reference to FIGS. 3*a* to 3*f*.

Figure 3A:
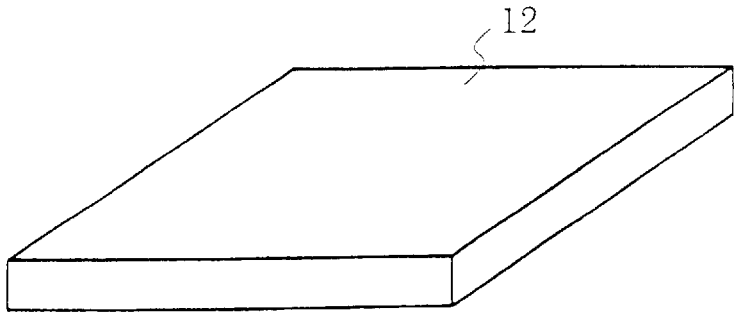
FIGS. 3*a* to 3*f* illustrate manufacturing steps of the pressurizing unit used in the first embodiment of the present invention.
Figure 3B:
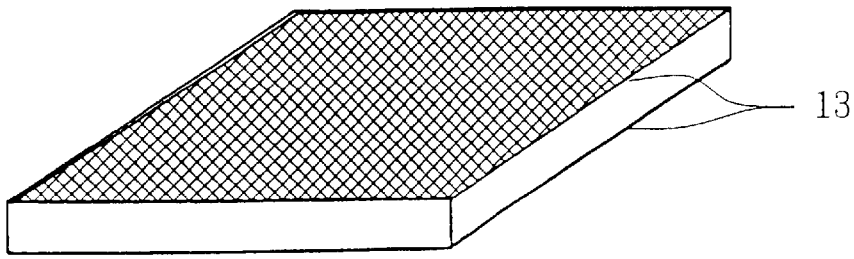
Figure 3C:
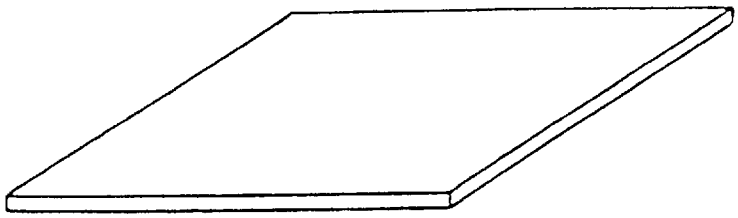
Figure 3D:
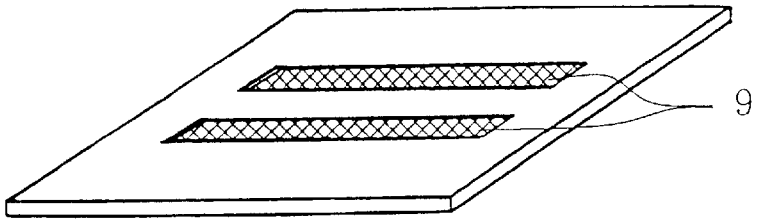
Figure 3E:
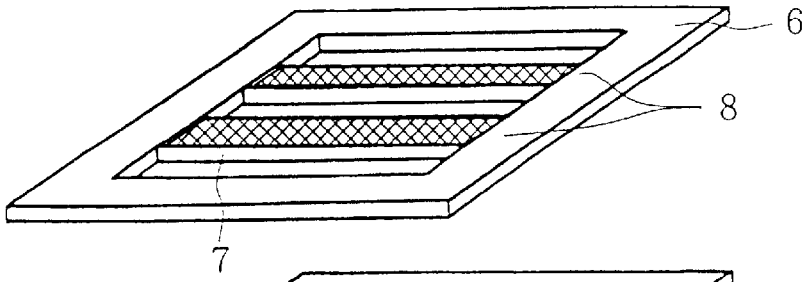
Figure 3F:
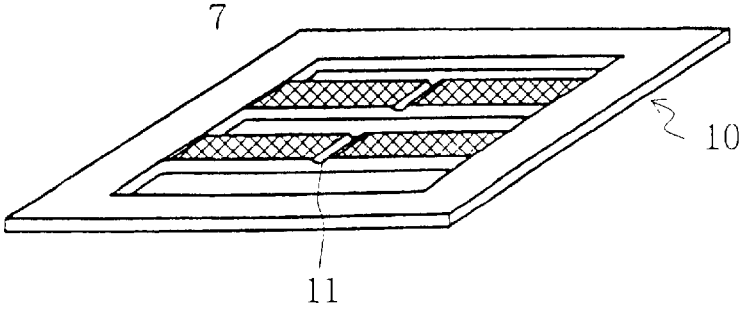

As shown in FIG. 3*a*, a green sheet of a piezo-electric material, 500 μm thick, is prepared and thin piezo-electric material plate 12 is prepared by sintering the green sheet at 1100° C. after an organic binder thereof is removed. Thereafter, as shown in FIG. 3*b*, polarizing electrodes 13 are formed on an upper and lower surfaces of piezo-electric material plate 12 by printing or vapor-deposition. Piezo-electric material plate 12 is polarized by applying a voltage (for example, 500 V) across the upper and lower polarizing electrodes 13. Thereafter, the upper surface of piezo-electric material plate 12, on which polarizing electrode 13 is formed, is lapped up to a depth (for example, 50 μm) determined on the basis of an output displacement and producing force of beam 7, which can be buckled, as shown in FIG. 3*c*. Then, as shown in FIG. 3*d*, discrete electrodes 9 are formed on portions of the lapped surface of piezo-electric material plate 12, which correspond to areas on which beams 7 each having recess 11 are formed. Thereafter, the wafer is sandblasted by using a pattern mask to form pressurizing unit 6 including beams 7 and support member 8 as shown in FIG. 3*e*. Alternatively, it may be possible to form pressurizing unit 6 by etching. Further, as shown in FIG. 3*f*, in order to form recesses 11 in beams 7, the center portions of beams 7 having discrete electrodes 9 thereof are sand-blasted up to a predetermined depth (for example, 20 μm) by using a pattern mask. With this sand-blasting, each discrete electrode 9 is divided to two electrode portions. Lead wires are connected to the respective electrode portions and a lead is connected to lower polarizing electrode 13 as common electrode 21. Common electrode 21 may take in the form of electrically conductive vibration plate 10 of nickel as thin as, for example, 5 μm.

In this embodiment, in order to prevent an initial distortion of the wafer produced by the polarization from residing in the pressure generating member of the actuator, the polarizing step is performed before beams 7 are formed. However, when a structure, in which partial distortion is not produced in the whole pressure generating member even when the polarization is performed, is employed (for example, all beams are polarized, etc.), it is possible to perform the polarization after beams 7 are formed. In such case, the manufacturing process can be simplified.

Figure 4:
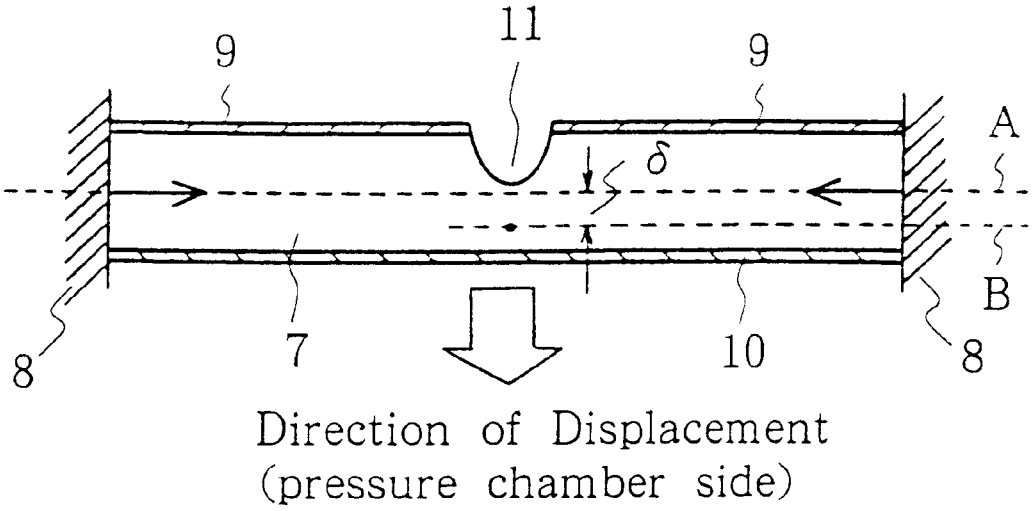
FIG. 4 illustrates an operation of the pressurizing unit used in the first embodiment of the present invention.

Now, an operation of pressurizing unit 6 formed as mentioned above will be described with reference to FIG. 4.

When a voltage (for example, 40 V) opposite in polarity to the polarizing direction is applied across discrete electrodes 9 and common electrode (vibration plate) 10, beams 7 between electrodes 9 and common electrode 10 tends to expand in their longitudinal directions by the lateral piezo-electric effect. However, opposite end portions 8 of each beam 7 are fixed to rigid member 4, a compressive load is produced along a center axis A of beam 7 in directions shown by inward arrows. Since recess 11 is formed in the surface of beam 7 on the opposite side to the displacement direction shown by a thick arrow, the center axis A of beam 7 to which the compressive load is exerted becomes eccentric with respect to an axis passing through a point in which a cross sectional primary moment in the recessed portion of beam 7 becomes zero by δ. Therefore, a bending moment is produced in recess 11, so that a buckling deformation is produced on the opposite side of the portion in which recess 11 is formed. This buckling deformation is transmitted through common electrode 10 to the pressure chamber 3 (FIG. 1) to pressurize an interior thereof. Thus, ink droplet 1 of ink 5 filling pressure chamber 3 is jetted through nozzle 2.

Pressurizing unit 6 was assembled in the ink jet recording head and the ink droplet jetting test was conducted by applying a voltage between discrete electrodes 9 and common electrode 10. It was confirmed that ink droplets 1 are stably jetted from nozzle 2.

(Second Embodiment)

Figure 5:
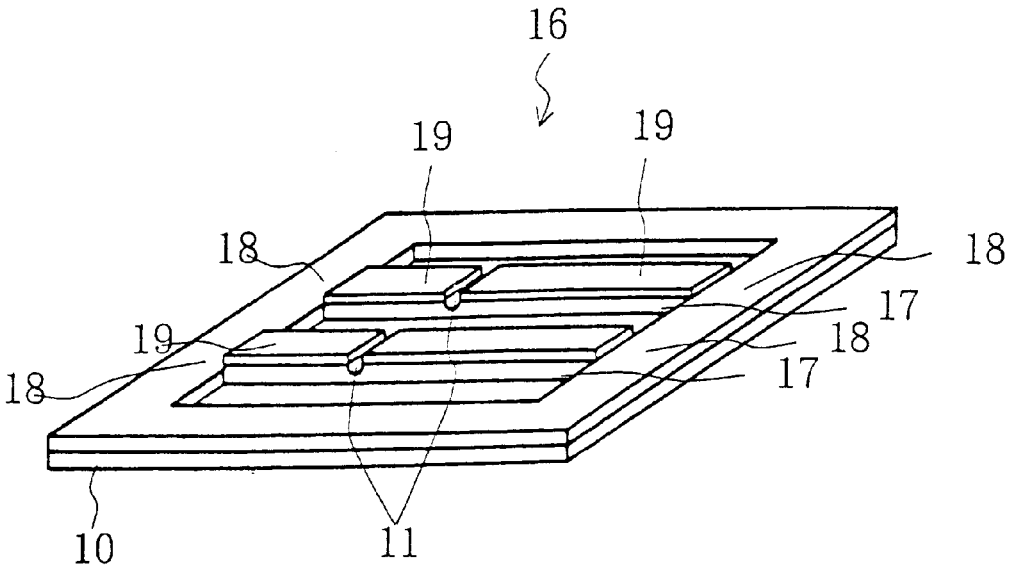
FIG. 5 is a perspective view of a main portion of a pressurizing unit used in the ink jet recording head of a second embodiment of the present invention.

FIG. 5 is a perspective view of a main portion of a pressurizing unit according to the second embodiment.

In FIG. 5, pressurizing unit 16 comprises beams 17 and support member 18 in the form of a frame for supporting opposite end portions of beams 17 and restricting expansion of the beams in a longitudinal direction thereof. Recesses 11 are formed in upper surfaces of beams 12 at positions deviated from centers of the beams by a predetermined distance, respectively. Each beam 17 is divided to two beam portions having different length by recess 11 and discrete electrodes 19 having different length are formed on the beam portions, respectively. Common electrode (vibration) 10 is formed on a whole lower surface of pressurizing unit 16. Other constructive structures of the second embodiment are substantially the same as those of the first embodiment and pressurizing means 16 is manufactured similarly.

In the second embodiment, since recesses 11 are formed in upper surfaces of beams 12 at positions deviated from centers of the beams by a predetermined distance, respectively, and discrete electrodes 19 having different length are formed on the beam portions, respectively, an amount of buckling deformation of beams 17 can be changed by changing discrete electrode 19 to be applied with electric signal. That is, when the electric signal is applied to only shorter discrete electrode 19, the amount of expansion of beam 17 in the longitudinal direction is smaller, so that the amount of buckling deformation thereof becomes small. On the other hand, when the electric signal is applied to only longer discrete electrode 19, the amount of expansion of beam 17 in the longitudinal direction is larger, so that the amount of buckling deformation thereof becomes large. Further, when the electric signal is simultaneously applied to both the shorter and longer discrete electrodes, the amount of expansion of beam 17 in the longitudinal direction is further increased, so that the amount of buckling deformation thereof is increased correspondingly.

In this second embodiment, it is possible to change the amount of buckling deformation of beam 17 by controlling the application of the electric signal to respective discrete electrodes 19, to thereby control an amount of ink of an ink droplet every time the latter is to be jetted.

This pressurizing unit 16 was assembled in the ink jet recording head and the ink droplet jetting test was conducted by applying an electric signal to discrete electrodes 19 in various combinations. It was confirmed that the ink droplets each having different size are stably jetted selectively.

(Third Embodiment)

Figure 6:
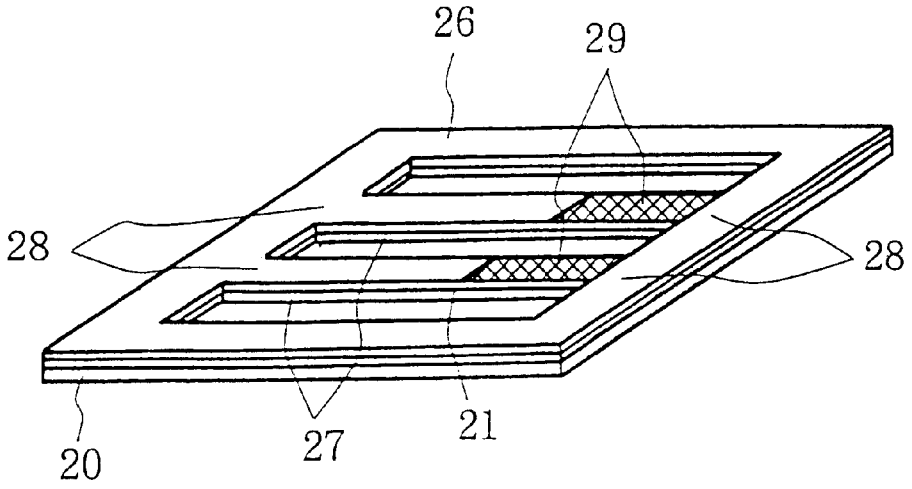
FIG. 6 is a perspective view of a main portion of a pressurizing unit used in the ink jet recording head of a third embodiment of the present invention.

FIG. 6 is a perspective view of a main portion of a pressurizing unit according to the third embodiment.

In FIG. 6, pressurizing unit 26 comprises beams 27 and support member 28 in the form of a frame for supporting opposite end portions of beams 27 and restricting expansion of the beams in a longitudinal direction thereof. Beams 27 and support member 28 have a double layer structure of piezo-electric green sheets. Common electrode 21 is provided in between the piezo-electric green sheets and discrete electrodes 29 for controlling a direction of buckling deformation constant are arranged on a portion of upper surfaces of beams 27. A pressure chamber to be pressurized by this pressurizing unit 26 is constructed similarly to that of the first embodiment.

A manufacturing method of pressurizing unit 26 used in the third embodiment will be described with reference to FIGS. 7*a* to 7*f*.

Figure 7A:
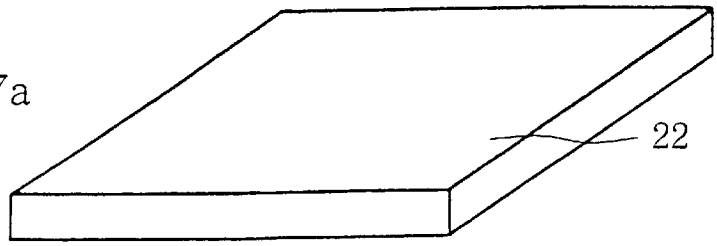
FIGS. 7*a* to 7*f* illustrate manufacturing steps of the pressurizing unit used in the third embodiment of the present invention.
Figure 7B:
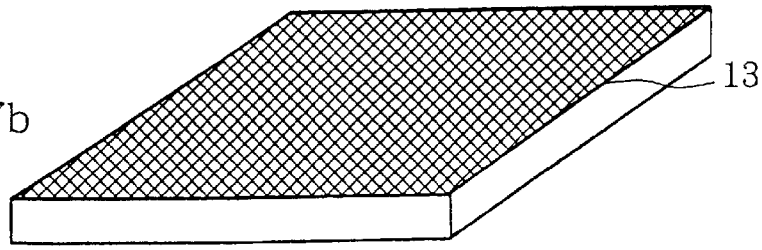
Figure 7C:
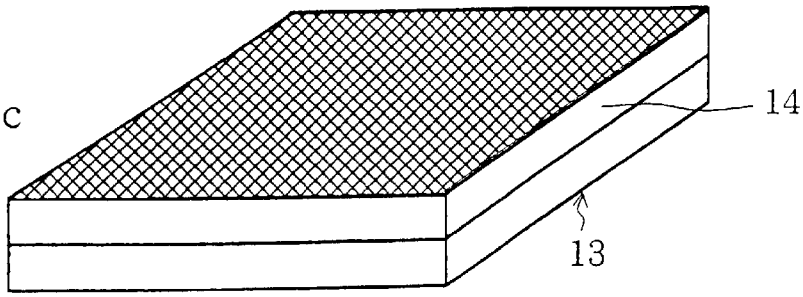
Figure 7D:
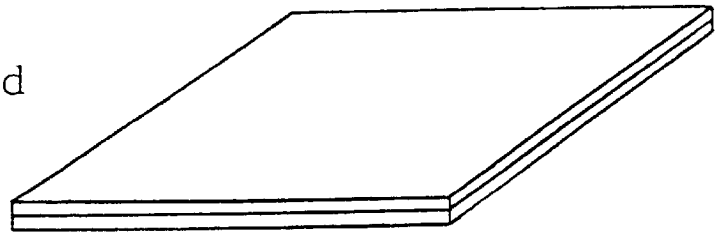
Figure 7E:
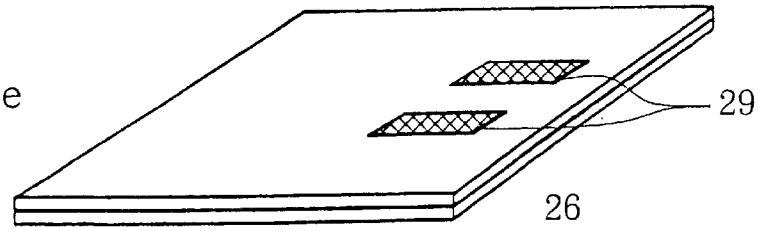
Figure 7F:
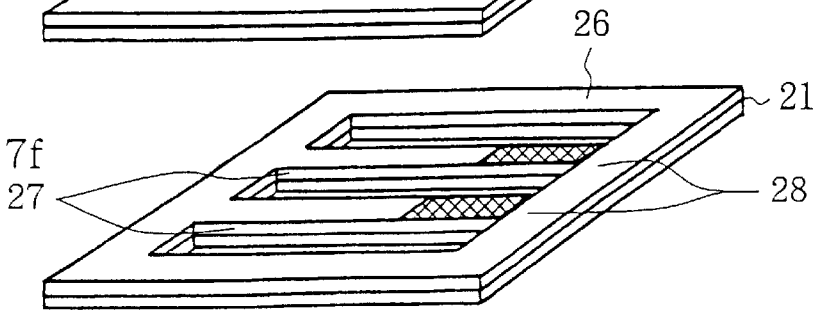

As shown in FIG. 7*a*, a pair of thin piezo-electric plates 22 are formed from a pair of piezo-electric green sheets each 500 $\mu$m thick, respectively. Then, polarizing electrode 13 is formed on a whole upper surface of each piezo-electric plate 22 by printing or vapor-deposition, as shown in FIG. 7*b*. Then, as shown in FIG. 7*c*, thin piezo-electric plates 22 having polarizing electrodes 13 are laminated and piezo-electric lamination 14 is formed by sintering the lamination at 1100° C. after an organic binder thereof is removed. Thereafter, lower polarizing electrode 13 is formed on a lower surface of piezo-electric material lamination 14 by printing or vapor-deposition. Piezo-electric material plates 22 of piezo-electric material lamination 14 are polarized by applying a voltage (for example, 500 V) between upper and lower polarizing electrodes 13 and middle polarizing electrode 13 between upper and lower piezo-electric material plates 22. Then, as shown in FIG. 7*d*, the upper and lower surfaces of piezo-electric material lamination 14 are lapped to predetermined depths (for example, 50 $\mu$m for the upper layer and 20 $\mu$m for the lower layer) set on the basis of the output displacement of beams 27 and the force generated thereby. Subsequently thereto, discrete electrodes 29 are formed on an area or areas of the lapped surface of upper piezo-electric material plate 22, which correspond to beams 27 by printing or vapor deposition wit using a pattern mask, as shown in FIG. 7*e*. Thereafter, the wafer is sand-blasted by using a pattern mask to form pressurizing unit 26 including beams 27 and support member 28 as shown in FIG. 7*f*. Alternatively, it may be possible to form pressurizing unit 26 by etching. Further, lead wires are connected to respective discrete electrodes 29 and a lead is connected to middle polarizing electrode 13 as common electrode 21.

In this embodiment, in order to prevent an initial distortion of the wafer produced by the polarization from residing in the pressure generating member of the actuator, the polarizing step is performed before beams 27 are formed. However, when a structure, in which partial distortion is not produced in the whole pressure generating member even when the polarization is performed, is employed (for example, all beams are polarized, etc.), it is possible to perform the polarization after beams 27 are formed. In such case, the manufacturing process can be simplified.

Figure 8:
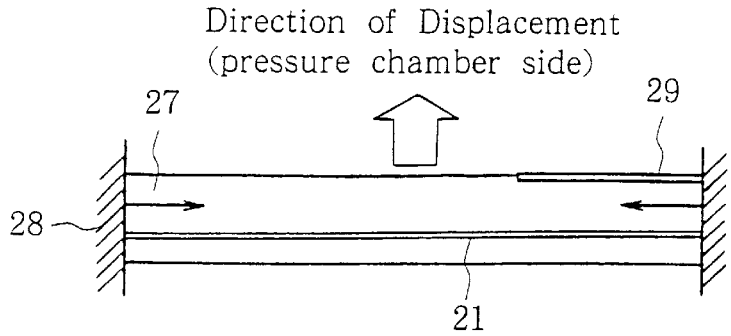
FIG. 8 illustrates an operation of the pressurizing unit used in the third embodiment of the present invention.
Figure 9:
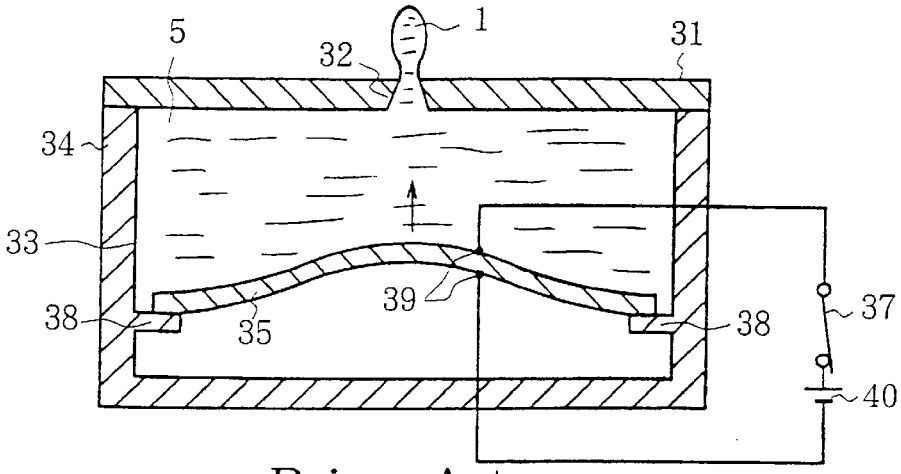
Prior Art FIG.9
FIG. 9 is a cross section of a conventional ink jet recording head, showing a main portion thereof.
Figure 10:
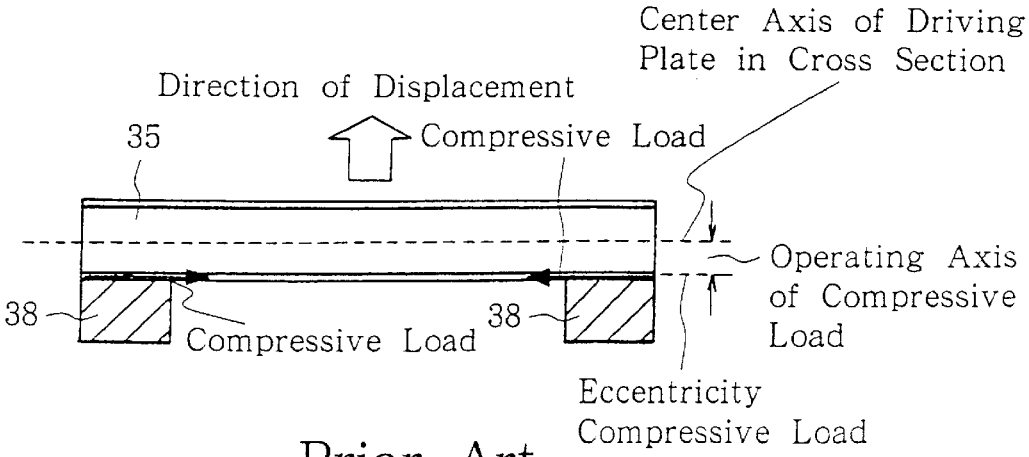
Prior Art FIG.10
FIG. 10 illustrates a pressurizing operation of the conventional ink jet recording head.

Now, an operation of pressurizing unit 26 formed as mentioned above will be described with reference to FIG. 8.

When a voltage opposite in polarity to the polarizing direction is applied between discrete electrodes 29 and common electrode 21 between upper and lower piezo-electric material plates 22, the upper layer of beam 27 tends to expand in its longitudinal direction by the lateral piezo-electric effect. However, since the opposite end portions of beam 27 are fixed to the rigid member, a compressive load is produced in the upper layer of beam 27 in directions shown by inward arrows. The upper surface, on which discrete electrode 29 is provided, of upper layer of the beam 27, in which the compressive load is exerted, is a free surface, while displacement of the lower surface thereof, which faces to common electrode 21 on the upper surface of the lower layer of beam 27, is restricted. Therefore, beam 27 is buckled on the side of the free surface by the compressive load. This buckling deformation of beam 27 is transmitted to the pressure chamber 3 (FIG. 1) and pressurizes the interior of pressure chamber 3. With this pressurization, ink 5 filling pressure chamber 3 is jetted through nozzle 2 as ink droplet 1.

This pressurizing unit 26 was assembled in the ink jet recording head and the ink droplet jetting test was conducted by applying a voltage between discrete electrodes 29 and common electrode 21. It was confirmed that ink droplets 1 are stably jetted from nozzle 2.

As described hereinbefore, according to the present invention, it is possible to exclude direct influences of the positioning error, the variation of adhering strength and the variation of the thickness of the adhesive layer, which are caused by the conventional ink jet recording head in which the vibration plate for pressurizing the ink chamber is adhered to the support member therefor by an adhesive, on the ink jetting characteristics. That is, since the adhesion of the vibration plate to the support member thereof is not used in the present invention, the precision adhering step is not required in the manufacturing steps thereof. Further, since there is no reactive force exerted directly on the adhesive layer, the number of effective reciprocal drives of the vibration plate is increased, causing the life of the ink jet recording head to be elongated, and it is possible to realize a reliable ink jet recording head with minimum failure. Further, it is possible to manufacture the ink jet recorder having uniform performance with minimum number of manufacturing steps.

What is claimed is:

1. An ink jet recording head comprising:

a rigid member defining a pressure chamber formed with a nozzle for jetting ink droplets; and pressurizing means for pressurizing ink filling said pressure chamber in response to an electric signal, said pressurizing means comprising:

at least one beam supported at opposite ends thereof; and a support portion integral with said at least one beam and defining a periphery which surrounds said at least one beam on all sides thereof, said support portion supporting said beam at said opposite ends thereof and restricting an extension of said beam in a longitudinal direction thereof so that, when said beam is expanded in the longitudinal direction by an application of the electric signal, said beam is buckled into a space of said pressure chamber.

2. The ink jet recording head as claimed in claim 1, wherein said beam is formed of a piezo-electric material and at least one electrode for applying the electric signal is formed on a surface of said beam.

3. The ink jet recording head as claimed in claim 2, wherein said electrode is formed partially on said beam in order to control the direction of buckling of said beam.

4. The ink jet recording head as claimed in claim 1, further comprising a heater for heating said beam by the electric signal, wherein said beam is formed of a material having a thermal expansion coefficient sufficient to enable said beam to be buckled by said heater.

5. The ink jet recording head as claimed in claim 4, wherein said electrode is formed partially on said beam in order to control the direction of buckling of said beam.

6. The ink jet recording head as claimed in claim 4, wherein said beam and said support portion are.formed from a piezo-electric material sheet and at least one electrode for supplying the electric signal is formed on said beam.

7. The ink jet recording head as claimed in claim 1, wherein a recess for controlling a direction of the buckling of said beam is formed in said beam.

8. The ink jet recording head as claimed in claim 7, wherein said recess is formed in said beam at a position deviated from a center of said beam.

9. An ink jet recording head comprising:

a container defining a pressure chamber and an ink ejection nozzle in communication with the pressure chamber; and an actuator in communication with the pressure chamber, the actuator comprising:

at least one longitudinally extendable beam having opposite ends; and a frame integral with the at least one beam and defining a periphery which surrounds the at least one beam on all sides thereof and supports the opposite ends of the beam such that when the beam is longitudinally extended, the frame restricts the extending of the beam and causes the beam to displace toward the pressure chamber.

10. The ink jet recording head as defined in claim 9, wherein the beam is extendable with the application of an electric signal.

11. The ink jet recording head as defined in claim 10, wherein the beam is formed of a piezo-electric material and includes at least one electrode on a surface thereof for applying the electric signal.

12. The ink jet recording head as defined in claim 11, wherein the at least one electrode is formed partially on the beam and operable to control a direction of displacement of the beam.

13. The ink jet recording head as defined in claim 9, wherein the beam is extendable with the application of heat.

14. The ink jet recording head as defined in claim 13, wherein the beam is formed of a material having a thermal expansion coefficient sufficient to enable the beam to be expanded by the heat.

15. The ink jet recording head as defined in claim 14, wherein beam includes at least one electrode formed partially on the beam and operable to control a direction of displacement of the beam with the application of the heat to the electrode.

16. The ink jet recording head as defined in claim 9, wherein the beam includes a recess operable to control a direction of the displacement of the beam.

17. The ink jet recording head as claimed in claim 16, wherein the recess is at a position deviated from a center of the beam.

18. An ink jet recording head comprising:

a container defining a pressure chamber and an ink ejection nozzle in communication with the pressure chamber; and an actuator in communication with the pressure chamber, the actuator comprising:

at least one longitudinally extendable beam having opposite ends; and first and second transverse support members integral with respective opposite ends of the at least one beam, the first and second transverse support members being coupled to the container in such a manner that when the beam is longitudinally extended the first and second transverse support members restrict the extending of the beam and cause the beam to displace toward the pressure chamber.

19. The ink jet recording head as defined in claim 18, wherein the beam is formed of a piezo-electric material and includes at least one electrode on a surface thereof for applying an electric signal so as to extend the beam.

20. The ink jet recording head as defined in claim 19, wherein the at least one electrode is formed partially on the beam and operable to control a direction of displacement of the beam.

21. The ink jet recording head as defined in claim 18, wherein the beam is formed of a material having a thermal expansion coefficient which enables the beam to be expanded by application of heat.

22. The ink jet recording head as defined in claim 21, wherein beam includes at least one electrode formed partially on the beam and operable to control a direction of displacement of the beam with the application of the heat to the electrode.

23. The ink jet recording head as defined in claim 18, wherein the beam includes a recess operable to control a direction of the displacement of the beam.

24. The ink jet recording head as claimed in claim 23, wherein the recess is at a position deviated from a center of the beam.

25. An ink jet recording head comprising:

a body defining a plurality of pressure chambers, the body including an open surface which exposes each of the plurality of pressure chambers; and a pressure generating member covering the open surface of the body, the pressure generating member including:

a plurality of longitudinally extendable beams each having opposite ends, each beam being positioned so as to apply pressure to a respective one of the plurality of pressure chambers; and a support frame integral with the opposite ends of each of the plurality of beams and surrounding the plurality of beams, the support frame supporting the opposite ends of each of the plurality of beams such that when a beam is longitudinally extended, the support frame restricts the extending of that beam and causes that beam to displace toward the pressure chamber.

26. The ink jet recording head as defined in claim 25, wherein the beam is formed of a piezo-electric material and includes at least one electrode on a surface thereof for applying an electric signal so as to extend the beam.

27. The ink jet recording head as defined in claim 26, wherein the at least one electrode is formed partially on the beam and operable to control a direction of displacement of the beam.

28. The ink jet recording head as defined in claim 25, wherein the beam is formed of a material having a thermal expansion coefficient which enables the beam to be extended by application of heat.

29. The ink jet recording head as defined in claim 28, wherein beam includes at least one electrode formed partially on the beam and operable to control a direction of displacement of the beam with the application of the heat to the electrode.

30. The ink jet recording head as defined in claim 25, wherein the beam includes a recess operable to control a direction of the displacement of the beam.

31. The ink jet recording head as claimed in claim 30, wherein the recess is at a position deviated from a center of the beam.

* * * * *